United States Patent [19]

Faulconer

[11] 3,983,312

[45] Sept. 28, 1976

[54] ELECTRICAL WIRE CONNECTOR

[76] Inventor: Harry A. Faulconer, 8323 Center Drive, La Mesa, Calif. 92041

[22] Filed: Apr. 13, 1972

[21] Appl. No.: 243,600

Related U.S. Application Data

[63] Continuation-in-part of Ser. No. 74,907, Sept. 23, 1970, Pat. No. 3,668,301, which is a continuation-in-part of Ser. No. 316, Jan. 2, 1970, abandoned, which is a continuation-in-part of Ser. No. 676,002, Sept. 28, 1967, abandoned, which is a continuation-in-part of Ser. No. 594,785, Nov. 16, 1966, abandoned.

[52] U.S. Cl. ..... 174/84 R; 174/88 R; 339/98

[51] Int. Cl.[2] ..... H01R 5/10; H01R 9/08

[58] Field of Search ..... 174/88 R, 88 S, 84 R, 174/84 S, 94 R, 94 S; 339/97 R, 97 C, 98, 99

[56] References Cited

UNITED STATES PATENTS 3,614,294 10/1971 Le Rouzic et al. ..... 174/88 R

FOREIGN PATENTS OR APPLICATIONS 1,213,013 11/1970 United Kingdom ..... 174/88 R

*Primary Examiner*—Laramie E. Askin
*Attorney, Agent, or Firm*—Elwood S. Kendrick

[57] ABSTRACT

An electrical wire connector, particularly suited for household use, is of generally cylindrical configuration, is made of insulative material, and has a cylindrical cavity extending from the top thereof and through a major portion of the length of the connector. A wire-receiving slot is cut in the sidewall of the connector and extends into communication with the cylindrical cavity. The surfaces which define the slot are inclined downwardly from the outer periphery of the slot to the inner periphery (i.e., where the slot joins the cavity), to force the wires inserted in the slot into the cylindrical cavity. A conductive plug or insert is snugly received and stored in the upper end of the cylindrical cavity. The plug is adapted to be forced downwardly by a suitable tool to electrically connect two wires inserted in the slot and sever the terminal end portions of these wires.

3 Claims, 20 Drawing Figures

FIG. 10
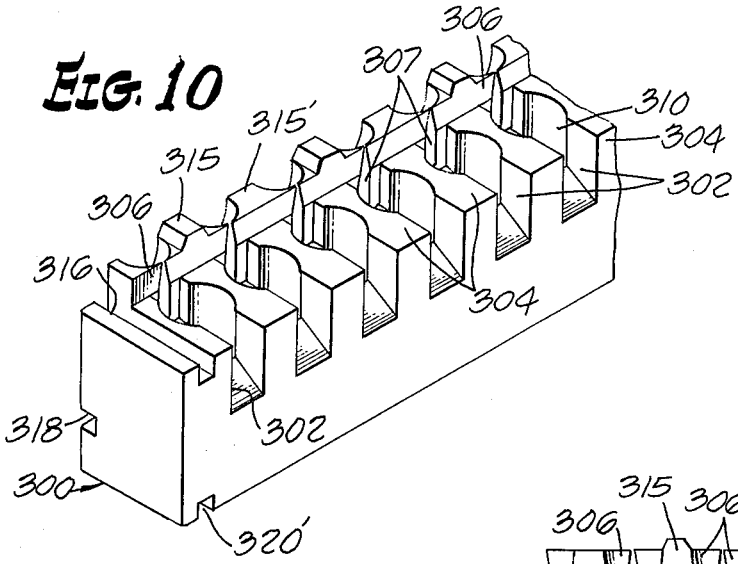
FIG. 11
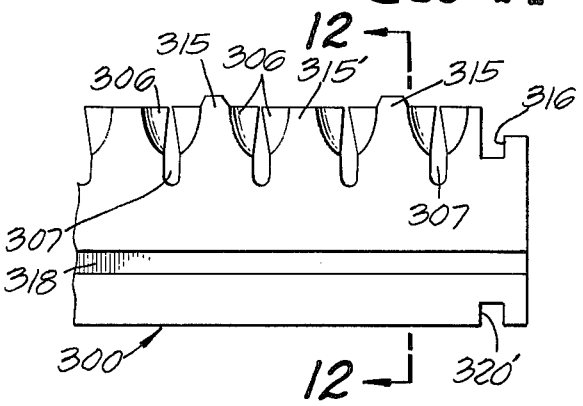
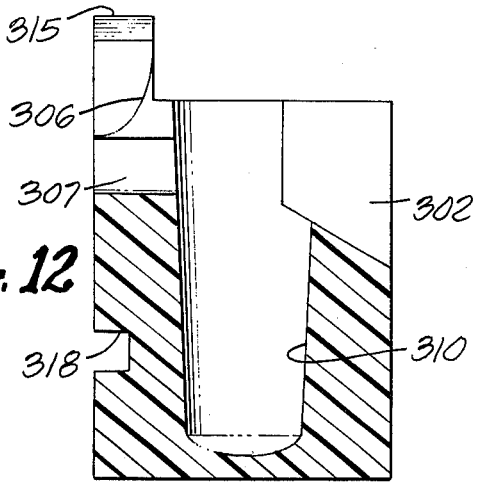
FIG. 12
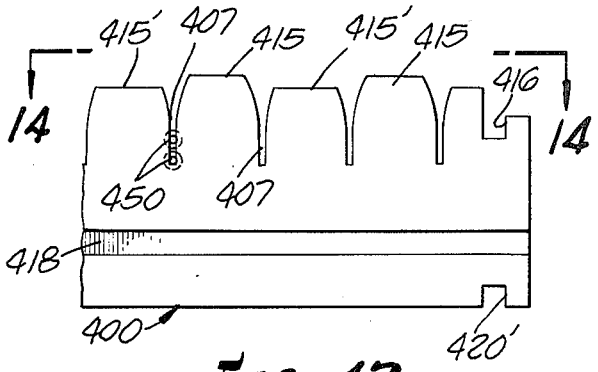
FIG. 13
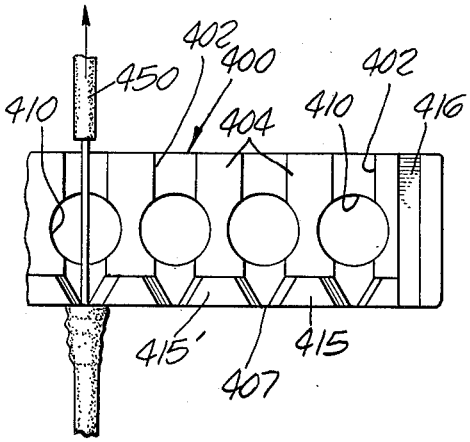
FIG. 14

ELECTRICAL WIRE CONNECTOR

RELATED APPLICATIONS

This application is a Continuation-In-Part of my copending application Ser. No. 74,907, filed Sept. 23, 1970 for "Means and Methods of Joining Conductors", now Pat. No. 3,668,301 issued June 6, 1972; which application is a Continuation-In-Part of a previous application Ser. No. 316, filed Jan. 2, 1970 for "Means and Methods of Joining Conductors", now abandoned; which application is a Continuation-In-Part of a previous application Ser. No. 676,002 filed September 28, 1967 for "Splicing Method and Apparatus", now abandoned; which latter application is a Continuation-In-Part of a previous application Ser. No. 594,785, filed Nov. 16, 1966 for "Splicing Method and Apparatus", now abandoned, but which was copending therewith.

SUMMARY OF THE INVENTION

This invention relates to an electrical wire connector comprised of an insulating body member having a longitudinally extending passage and a radial slot communicating with the passage. The radial slot has an internal edge portion defining a wire cutting edge. A conductive force transfer member is stored in the upper section of the longitudinally extending passage and is movable downwardly in the passage to effect severing of electrical wires inserted into the radial slot and to join the wires electrically. The connector is particularly suited for household use and provides a means whereby electrical wires can be easily and effectively severed and joined simultaneously.

BRIEF DESCRIPTION OF THE DRAWINGS

FIG. 10 is a front perspective view of still another embodiment of a connector block constructed according to the teachings of the present invention.

FIG. 11 is a rear elevation view of the connector block shown in FIG. 10.

FIG. 12 is a sectional elevation view of the connector block shown in FIGS. 10 and 11, taken along the plane 12—12 of FIG. 11 and looking in the direction of the arrows.

FIG. 13 is a rear elevation view of another embodiment of a connector block constructed in accordance with the teachings of the present invention.

FIG. 14 is a top plan view of the connector block shown in FIG. 13 and looking in the direction of the arrows 14—14.

DETAILED DESCRIPTION

FIGS. 1–8 illustrate a connector block and connector block segments which are particularly adapted to be employed in a stacked array.

An elongated connector block 200 adapted for use in a stacked array is shown in FIGS. 1–4. The elongated block 200 includes a plurality of spaced, parallel channels 202 separated from one another by upstanding dividers 204 of the block.

Figure 4:
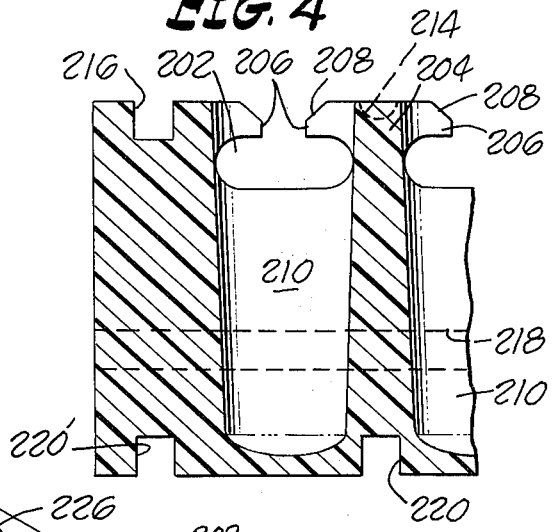
FIG. 4 is another sectional elevation view of the connector block shown in FIGS. 1 and 2, taken along the plane 4—4 of FIG. 2 and looking in the direction of the arrows.

As best shown in FIG. 4, the upstanding dividers 204 of the block 200 have laterally extending projections 206 on the rear ends thereof. These lateral projections 206 extend across a portion of the rear ends of the channels 202 to retain wires in the channels in a manner described more fully below. Each projection has a bevelled or inclined ramp portion 208 on the upper side edge thereof to facilitate insertion of wires into the channels.

Figure 1:
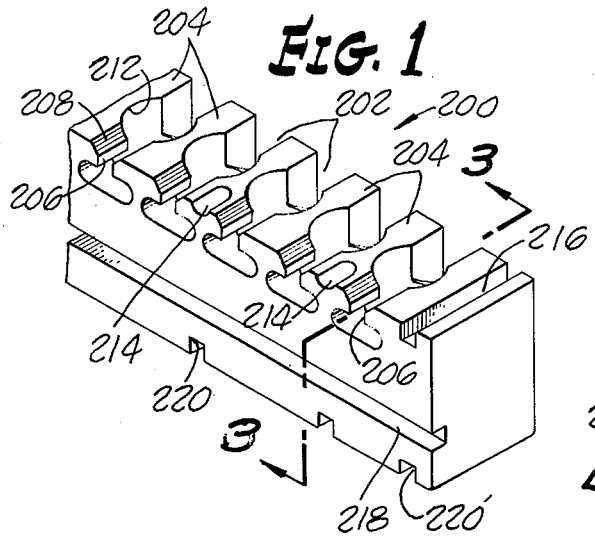
FIG. 1 is a perspective view of a multiple-wire connector block constructed according to the teachings of the present invention, the block being viewed from the rear.
Figure 2:
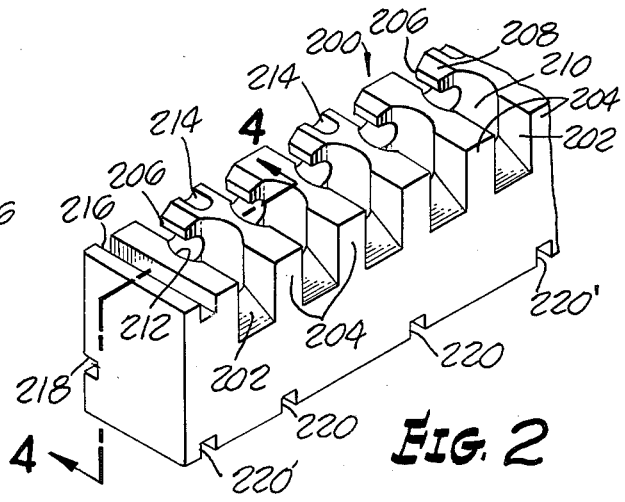
FIG. 2 is a front perspective view of the connector block shown in FIG. 1.
Figure 3:
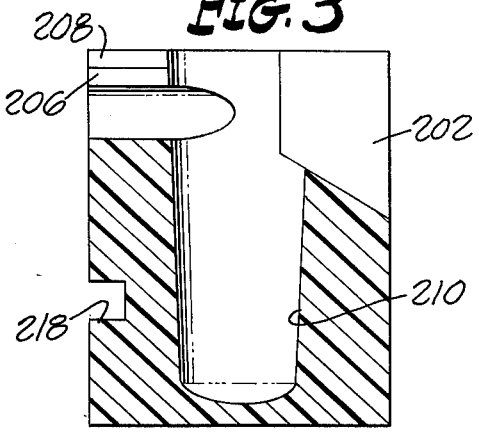
FIG. 3 is a sectional elevation view of the connector block shown in FIGS. 1 and 2, taken along the plane 3—3 in FIG. 1 and looking in the direction of the arrows.

As best shown in FIGS. 3 and 4, downwardly extending sockets or cavities 210 are provided in the connector block for receiving and retaining the terminal ends of electrical wires to be connected. One such socket or cavity 210 is provided between each adjacent pair of upstanding portions 204. Each socket 210 is adapted to receive one, two or more electrical wires to be connected. The sockets are generally cylindrical, may be slightly tapered, and are particularly designed to receive conductive inserts. The central side portions of each upstanding portion 204 may have arcuate cuts 212 therein to facilitate insertion of the cylindrical inserts or plugs into the sockets or cavities 210.

It will be noted that the connector block 200 has a rectilinear profile which facilitates stacking of these blocks and/or similar block segments to form a compact array. The upper rear surfaces of alternate ones of the upstanding dividers 204 may be provided with suitable indicia, such as the troughshaped depressions or indentations 214 to facilitate identification of wire pairs. The alternate dividers 204 which are not provided with such depressions 214 may then be readily recognized as the "pair-splitting" dividers to assure the user that one wire (e. g., the positive or "tip" wire, in a communications wire network) is placed on one side of the divider and the other wire of the pair (e. g., the negative or "ring" wire) is positioned in the channel 202 on the other side of the divider.

A transversely extending groove is provided in the top surface of the connector block 200 at each end thereof, and a longitudinally extending groove 218 is provided in the rear surface of the block, and a plurality of spaced, transversely extending grooves 220 are provided in the bottom surface of the block, the end grooves being designated 220'.

Figure 5:
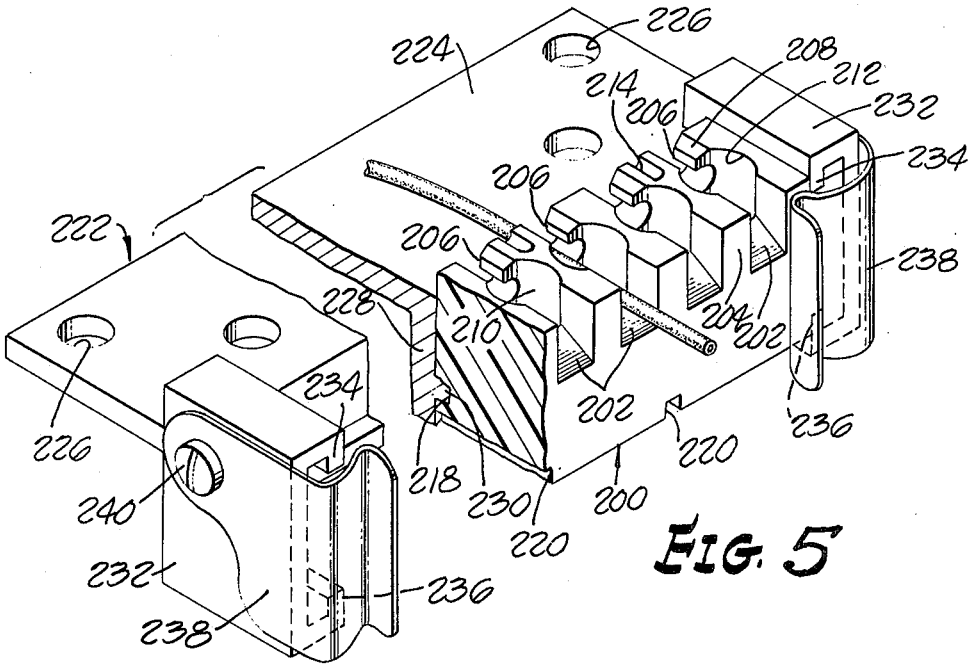
FIG. 5 is a front perspective view showing the manner in which the connector block of FIGS. 1 and 2 may be mounted on a temporary retaining fixture to facilitate connection of selected insulated wires thereto.

A fixture 222, shown in FIG. 5, is designed to retain the connector block 200 temporarily while the wires to be joined are inserted and connected in place. The fixture 222 includes a horizontal plate 224 having apertures or holes 226 therein for securing the fixture on a suitable support. A vertical wall 228 extends downwardly from the horizontal plate 224 and has a horizontal ledge 230 projecting therefrom. As shown in FIG. 5, the ledge or projection 230 is adapted to be snugly received in the longitudinally extending groove 218 in the backside of the connector block 200 to releasably retain and rigidly support the block 200 on the fixture 222, with the backside of the block against the vertical wall 228 of the fixture 222.

The fixture 222 also has generally C-shaped brackets 232 extending outwardly from the ends of the plate 224 for securely retaining the ends of the connector block 200. Each of the brackets 232 includes a downwardly projecting leg 234 adapted to be snugly received in the transverse groove 216 in the upper end surface of the block, and an upwardly projecting leg 236 adapted to be received in an end groove 220' in the bottom surface of the block 200. As shown in FIG. 5, the vertical wall 228 and the horizontal ledge 230 support the block 200 from the rear, and the brackets 232 support the block from the sides. A flange 238 is rotatably mounted on the outer side of its associated bracket 232 by a screw 240 for pressing the block 200 against the vertical wall 228.

It will be appreciated that the fixture 222 may serve as a convenient device for temporarily retaining a connector block 200 while wires to be joined are inserted and connected in the block.

It may also be appreciated, from viewing FIG. 5, that the horizontally extending projections 206 on the sides of the rear portions of the upstanding dividers 204 serve to retain the wires in each channel, and prevent inadvertent upward removal of the wires from the channels.

Figure 6:
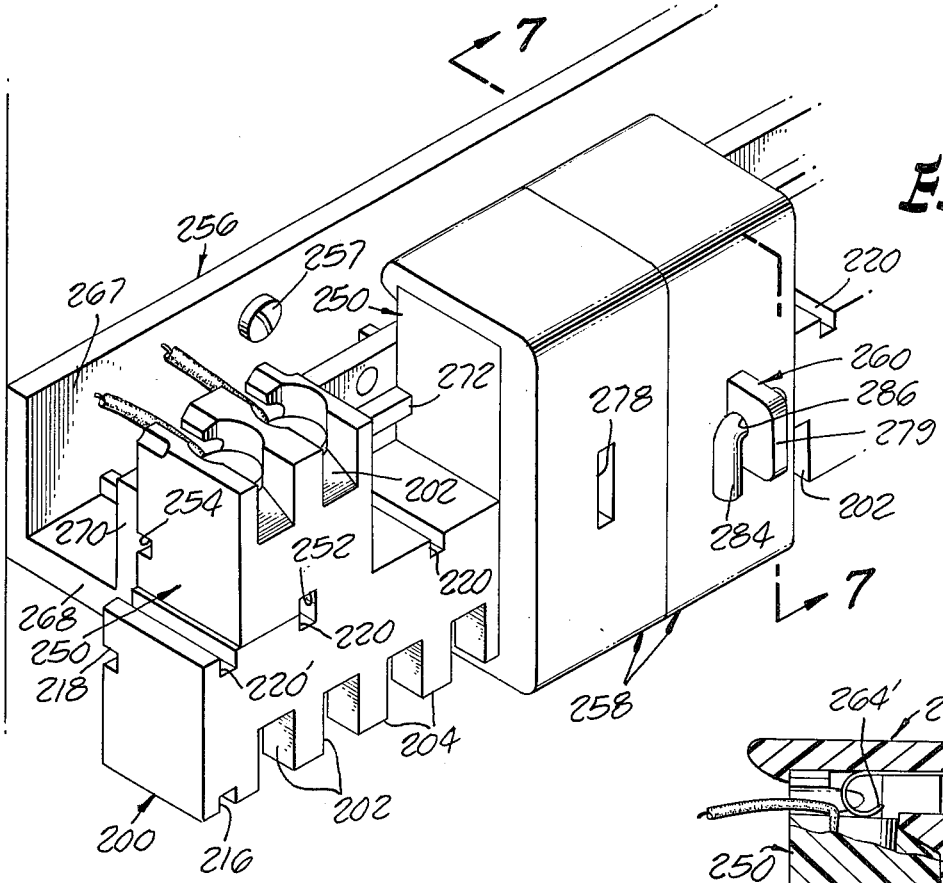
FIG. 6 is a front perspective view of an installation of connector blocks constructed according to the teachings of the present invention, said assembly including the connector block structure of FIGS. 1—5 in an inverted position, with connector block segments mounted and retained thereon by suitable retaining structures.

FIG. 6 illustrates the manner in which connector blocks 200 of the type shown in FIGS. 1–5 may be assembled in a stacked array with connector block segments 250 for connecting wire pairs, one pair at a time, to selected pairs of wires which have been connected previously in a block 200.

As best shown in FIG. 6, the connector block segment 250 is identical to the connector block 200, except that it is shorter and is not provided with the transverse end grooves such as grooves 216 and 220' in the ends of the block 200.

The connector block segment 250 is provided with a groove 252 in its bottom face. The groove 252 is adapted to align with one of the grooves 220 in the connector block 200 when the block 200 is inverted (as shown in FIG. 6) and the block segment 250 is stacked bottom-to-bottom on the block 200.

Figure 7:
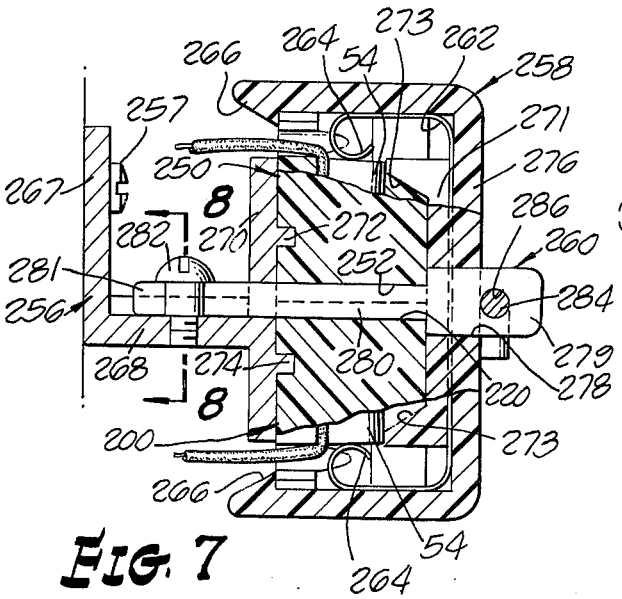
FIG. 7 is a sectional elevation view of the assembly shown in FIG. 6, taken along the plane 7—7 of FIG. 6 and looking in the direction of the arrows.

As best shown in FIG. 7, the individual connector block segments 250 and the connector block 200 are structurally and electrically connected by means of a mounting fixture 256, a C-shaped clamp 258 which has a generally C-shaped spring-clip 262 suitably secured (e. g., by sonic welding) to its inner surface, and an indexing finger 260.

Referring to FIG. 7, it will be seen that the spring clip 262 has inwardly-turned end portions 264-264 which contact and electrically connect the conductive inserts or plugs 54 in the cavities or sockets of a connector block 200 and a block segment 250. Each conductive plug or insert 54 is in electrical contact with the terminal end or ends of the wire or wires in its associated socket 210. The spring clip 262 is made of a conductive material and establishes electrical connection between the wire or wires in one of the sockets 210 of the block segment 250 and the wire or wires in the socket 210 of the block 200 which is directly beneath it.

The clamp 258, which is preferably constructed of a relatively flexible, insulative material (e. g., glass-filled nylon) snaps over the top surfaces of the block segment 250 and the block 200 to maintain the block segment 250 in bottom-to-bottom relationship on the inverted block 200. It will be noted, from FIG. 7, that the ends of the clamp 258 are provided with extensions or lips 266 which snap over the upper rear surfaces of the segment 250 and the block 200 to maintain them in vertical alignment.

Each clamp 258 is provided with a pair of spaced, parallel indexing protuberances 271 having upper and lower ramp surfaces 273 adapted to be received in the forward portions of the channels 202 in the connector block 200 and the corresponding block segment 250 (see FIG. 7). These indexing ramps 273 function to assure positive alignment of the associated channels 202, 202 in the connector block 200 and the block segment 250. The protuberances 271 are preferably made in two halves with the conductive spring clip 262 disposed therebetween.

The segment 250 and the block 200 are also maintained in assembled relation by means of the mounting fixture 256 which includes a vertical mounting plate 267, a horizontally extending wall 268 integrally connected to the bottom of the mounting plate 267, a vertical wall 270 integrally connected to the other end of the horizontal wall 268, and a pair of substantially parallel, vertically-spaced horizontal ledges or projections 272, 274 which are adapted to be snugly received by the longitudinally extending grooves 254 and 218, respectively, in the segment 250 and the block 200. The fixture 256 is adapted to be secured to a fixed support, as by screws 257 through plate 267 (FIG. 7).

It is to be noted that in some situations it may be desirable to have the array or assembly unsecured or "free-floating", and the support fixture 256 may be eliminated. (See, for example, the array of FIG. 9, described below).

The vertical wall 276 of the clamp 258 is provided with a slot 278 for receiving the enlarged end or head 279 of the indexing finger 260. As best shown in FIG. 7, the indexing finger 260 includes an elongated shaft 280 which extends forwardly from the head 279 and into the channel formed by the aligned slots 252 and 220 in the block segment 250 and the block 200, respectively. The forward end 281 of the shaft 280 is adapted to be secured to the horizontal wall 268 of the mounting fixture 256 by the head of a screw 282 in the wall 268 (see FIG. 8). A keeper bar 284 extends through a hole 286 in the head 279 of the indexing finger 260 to prevent accidental removal of the clamp 258.

Thus, the indexing finger 260 maintains the block 200, block segment 250, fixture 256 and clamp 262 in assembled relationship. The shaft 280 in the channels 252, 220 aligns the channels and sockets of the block segment 250 with the associated, proper channels and sockets in the block 200 and precludes lateral movement of the segment with respect to the block.

Of course, it is contemplated that it may be desirable, in some situations, to stack two connector blocks 200 bottom-to-bottom. In such a situation it would be desirable to have the clamp 258 of a length equal to the length of the blocks 200, with a plurality of spaced spring-clips 262 secured to the inner surface of the elongated clamp.

Figure 9:
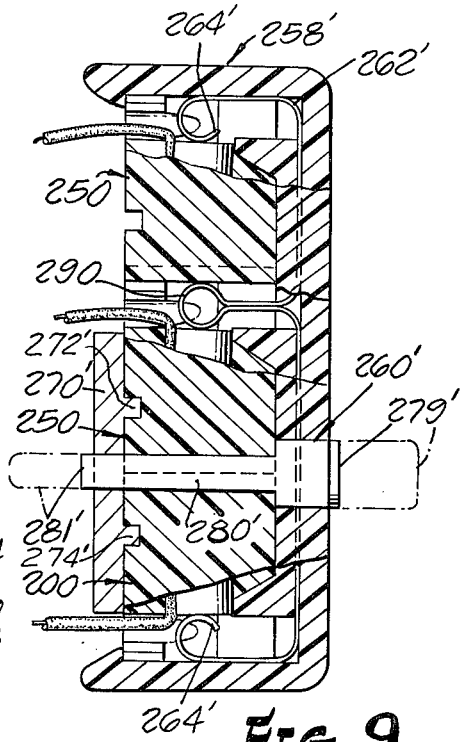
FIG. 9 is a sectional elevation view illustrating still another manner in which connector blocks of the type shown in FIGS. 1–5 and 6–8 may be assembled in a stacked-module array.
Figure 8:
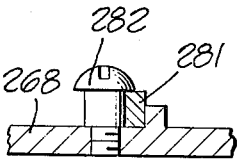
FIG. 8 is a sectional elevation view of a portion of the assembly shown in FIGS. 6 and 7, taken along the plane 8—8 of FIG. 7 and looking in the direction of the arrows.
Figure 15:
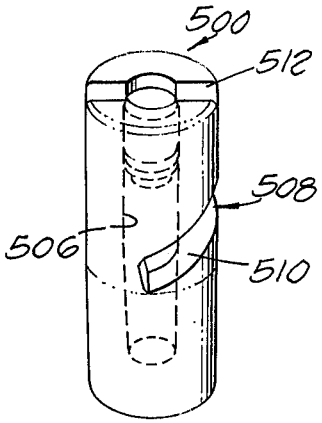
FIG. 15 is a perspective view of another embodiment of a connector member constructed in accordance with the teachings of the present invention.
Figure 16:
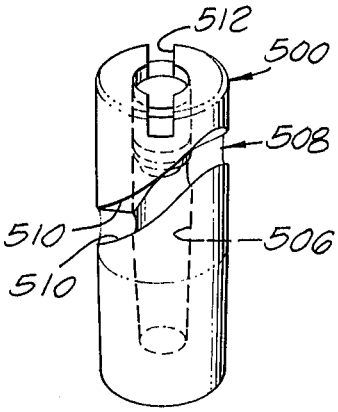
FIG. 16 is a perspective view of the connector member of FIG. 15 as the connector member appears when rotated approximately 90°, in a clockwise direction, from the position of FIG. 15.
Figure 17:
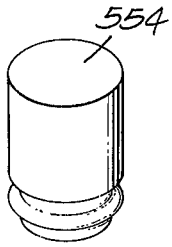
FIG. 17 is a perspective view of the plug which forms a part of the connector member of FIGS. 15 and 16.

FIG. 9 illustrates how three connector blocks 200 and/or block segments 250 may be effectively assembled in a three-row array by employing a larger clamp 258' and a modified form of a spring clip 262'.

The spring-clip 262' has inwardly-turned ends 264', 264' ( like the ends 264, 264 on clip 262 in the FIG. 7 embodiment), and is further provided with a bowed portion 290 for establishing electrical connection between the wires in the top block segment and the intermediate block segment 250.

The three-high assembly or array shown in FIG. 9 is "free-floating" (i. e., is not secured to or mounted on a fixed structure). A vertical support wall 270' is mounted against the rear surfaces of the block 200 and segment 250 by means of spaced ledges 272' 274', and the head 279' and the end 281' of the indexing finger 260' are bent back against the clamp 262' and the support wall 270', respectively.

The clamp 258' is identical to the clamp 258 of the FIG. 7 embodiment, except that it is larger in height to secure three (rather than two) blocks 200 and/or block segments 250.

Although FIG. 9 shows two block segments 250, 250 stacked upon a connector block 200, it will, of course, be appreciated that 1, 2 or 3 block segments and/or blocks 200 may be arranged in a three-high stacked array using the clamp, spring-clip and fixture shown in FIG. 9.

The stacked block or module concept illustrated in FIGS. 6–9 is a particularly useful arrangement for connecting telephone wires at a neighborhood distribution point (e. g., a housing tract, a high-rise building, etc.). Use of the block segment concept (i. e., stacking block segments 250) on an elongated connector block 200 permits selected pairs of wires to be connected, disconnected, reconnected, etc. in the relatively compact array at any time.

The array shown in FIGS. 6 and 7 is assembled by first mounting the elongated connector block 200 on the temporary mounting structure 222 (FIG. 5), feeding the wires to be connected into the channels 202 with a portion of each wire bridging the cavity or socket 210 into which it is to be forced, and forcing a conductive insert or plug 54 into each socket or cavity 210 to substantially simultaneously pierce the insulation on the wire and establish electrical contact between the plug 54 and the wire and, substantially simultaneously, sever the terminal end portion of the wire (i. e., the end of the wire extending beyond the forward edge of the socket.

The connector block, with the wires attached, may then be mounted in an inverted or upside-down position on the bottom portion of the fixture 256 shown in FIGS. 6 and 7. Thereafter, individual block segments 250 are stacked bottom-to-bottom on the block 200, the wires to be connected in the segment are fed into their respective channels in bridging relation to the cavities or sockets in the segment, and the conductive plugs are applied to force the end portions of the wires into the cavities or sockets, pierce the wire insulation and sever the ends of the wires.

Clamps 258 are then applied to secure block segments 250 on the blocks 200 with the spring clips 262 establishing electrical connection between the associated conductive plugs 54 in the block segment 250 and the connector block 200.

Next, an index finger 260 is inserted through the slot 278 in the wall of the clamp 258 and through the channel formed by the aligned grooves 252 and 220 in the segment 250 and the block 200, respectively. The forward end of the shaft 280 of the finger 260 is secured to the horizontal wall of the fixture 256 by tightening the screw 282 (see FIG. 8), and the keeper bar 284 is inserted through the aperture 286 in the head 279 of the finger 260.

The connector block 300 shown in FIGS. 10–12 is similar to the connector block 200 shown in FIGS. 1-5. The block 300 differs from the block 200 in that (1) the wire retaining means on the upper rear portion of the block is different, and (2) no transverse alignment grooves are provided in the bottom surface of the block 300 since the block 300 is not designed to be used in a stacked array. The block 300 is useful for connecting one, two or more wires in each socket 310 to one another and/or one or more wires in other sockets by inserting a conductive plug or slug 54.

The block 300 includes channels 302, upstanding dividers 304, and cavities or sockets 310 which are substantially identical to the corresponding channels 202, dividers 204 and sockets 210 in the block 200 of FIGS. 1-5.

The connector block 300 (FIGS. 10-12) is also provided with transversely extending grooves 316, 320' in the upper and lower surfaces, respectively, adjacent the ends of the block and a longitudinally extending groove 318 in the rear surface thereof so that the block may be placed on a suitable mounting fixture, such as fixture 222 shown in FIG. 5.

The wire retaining means on the upper rear edge of the block 300 comprises a plurality of upstanding members 315, 315' having laterally extending flexible tongues 306. As best shown in FIG. 11, a relatively narrow wire-retaining slot 307 is formed between adjacent tongues 306 for receiving wires to be connected in the connector block 300, the said wire retaining slots being narrowest at the top, or entrance, to retain wires inserted therein.

It will be noted that the divider 315 extends higher than the adjacent dividers 315' and that the higher and lower dividers (315 and 315', respectively) are alternately arranged. By virtue of this alternate arrangement of the higher and lower dividers, the higher dividers 315 serve as pair splitters to assist the user in placing wires (e. g., "ring" and "tip" wires in the communications field).

The flexible tongues 306 serve to releasably retain wires in the slots 307.

The connector block 400 shown in FIGS. 13 and 14 is similar to the connector block 300 shown in FIGS. 10-12, but has a different wire retaining structure on the upper rear end thereof.

The block 400 includes channels 402, upstanding dividers 404, cavities or sockets 410 which are substantially identical to the corresponding channels, dividers and sockets in the blocks 200 and 300 of FIGS. 1–5 and FIGS. 10–12, respectively.

The connector block 400 (FIGS. 13-14) is also provided with transversely extending grooves 416, 420' in the upper and lower surfaces, respectively, adjacent the ends of the block and a longitudinally extending groove 418 so that the block may be placed on a suitable mounting fixture, such as fixture 222, shown in FIG. 5.

The wire retaining means on the upper rear edge of the block 400 comprises a plurality of upstanding sorter fingers 415, 415'. Wire retaining slots 407 are formed between adjacent edges of the fingers 415, 415' for receiving wires to be connected in the connector block 400.

It will be noted that the sorter fingers 415 extend higher than the adjacent sorter fingers 415' and that the higher and lower fingers (415 and 415', respectively) are alternately arranged. By virtue of this alternate arrangement of the higher and lower sorter fingers, the higher fingers 415 serve as pair splitters to assist the user in placing wire pairs (e. g., "ring" and "tip" wires in the communications field).

It will also be noted, from FIG. 14, that the edges of the fingers 415, 415' are relatively sharp, and function to strip insulation from the wires inserted therefrom. This is accomplished in the following manner. Referring to FIG. 14 a wire 450 is held in bridging relationship across the top of the connector block 400 and is then forced downwardly through the adjacent sharp edges of the sorter fingers 415, 415', into the slot 407. As the wire is forced into the slot 407, the relatively sharp edges of the adjacent fingers cut through the insulation on the wire but do not sever the wire. Thereafter, the wire is pulled forwardly (upwardly, as viewed in FIG. 14), thereby stripping the insulation from the portion of the wire so pulled. It is to be noted that the insulation which gathers at the rear surface of the block (see FIG. 14) provides a strain relief function to resist bending (and possible severing) of the wire immediately adjacent the rear edge of the block 400.

The electrical connection and severance function is provided in the same manner as the other connecting blocks disclosed herein; i. e., a conductive plug or insert is forced into the cavity or socket 410 which the wire 450 overlies, thereby forcing the wire into the socket and severing the terminal end portion thereof.

Figure 18:
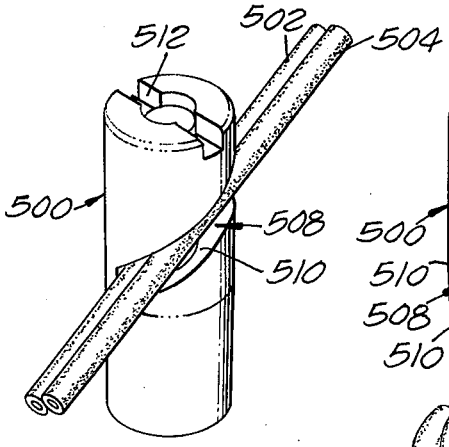
FIG. 18 is a perspective view illustrating the manner in which two wires to be electrically connected or "spliced" are placed in the connector member of FIGS. 15 and 16 preparatory to making the connection or splice.
Figure 19:
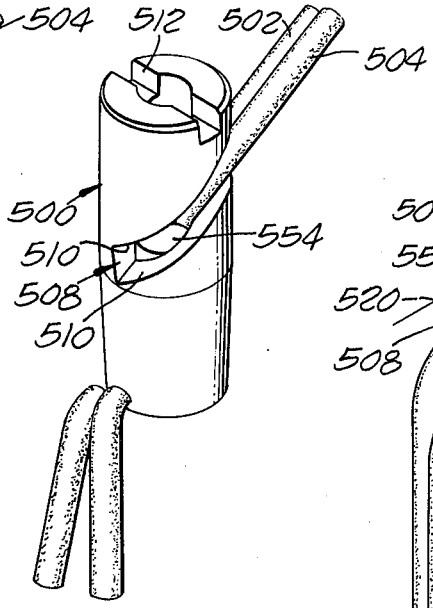
FIG. 19 is a perspective view similar to FIG. 18, illustrating the connector member and the wires after the wires have been connected or spliced in the connector member.
Figure 20:
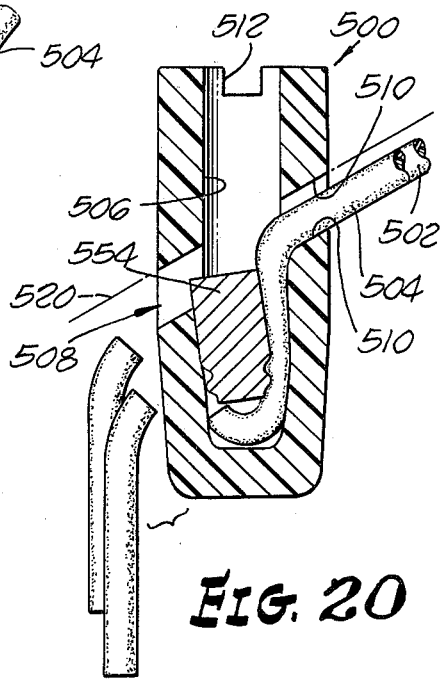
FIG. 20 is a sectional elevation view of the connector block - wire connection shown in FIG. 19.

FIGS. 15–20 illustrate a connector member 500 which is adapted to electrically connect a pair of wires (e. g., 502, 504, FIGS. 18–20).

The connector 500, which is particularly suited for household use, is of generally cylindrical configuration, is made of insulative material, and has a cylindrical cavity 506 extending from the top thereof and through a major portion of the length of the connector. A wire-receiving slot 508 is cut in the side wall of the connector and extends into communication with the cylindrical cavity 506. The surfaces 510, 510 which define the slot are inclined downwardly from the outer periphery of the slot to the inner periphery (i. e., where the slot joins the cavity 506), to force the wires (e. g., 502, 504) inserted in the slot into the cylindrical cavity 506.

A conductive plug or insert 554 is snugly received and stored in the upper end of the cylindrical cavity 506. The plug is adapted to be forced downwardly to a suitable tool to electrically connect two wires inserted in the slot 508 and sever the terminal end portions of these wires. This is accomplished in the following manner.

As shown in FIG. 18, the wires to be joined, 502 and 504, are inserted into the inclined slot 508, the inwardly inclined surfaces 510, 510 thereof forcing the wires into the cylindrical cavity 506. Thereafter a suitable tool is employed to force the conductive plug 554 downwardly against the portion of the wires, 502 and 504, which extend across the cavity 506, thereby penetrating the insulation on that portion of the two wires and substantially simultaneously severing the end portions of the wires. This is illustrated in FIGS. 19 and 20.

As shown in FIG. 20, the conductive plug 554 remains in electrical contact with each of the wires, thereby electrically connecting the wires.

Since the upper portion of the connector 500 serves no function after the connection has been made (i. e., after the wires have been joined and the terminal ends severed) it is contemplated that the upper half of the connector (i. e., the portion of the connector 500 above the phantom line 520 in FIG. 20) may be snapped off or cut away to reduce the space occupied by the finished connection.

It is contemplated that while connectors 500 may be utilized individually to electrically connect pairs of wires, the connectors may be loaded in quantities in a suitable tool and fed from the tool, one at a time, to a position where wires to be joined may be inserted into the slot 508 and driven by the slug or plug 554 to penetrate the insulation, establish electrical connection and sever the terminal ends. A transverse slot 512 may be provided in the upper end of the connector body, as shown in FIGS. 15, 16 and 18–20, to index the connector in such a tool so that the slot 508 will be positioned in the tool to receive the wires to be connected.

Of course, numerous modifications and changes may be made to the particular embodiments described above without departing from the spirit and scope of the present invention. Accordingly, it is intended that the scope of protection of this patent be limited only by the following claims.

I claim:

1. An electrical wire connector, comprising:

a generally tubular body of insulative material; said generally tubular body having a generally tubular outer peripheral surface; said generally tubular body having a generally tubular inner peripheral surface defining a longitudinal passage which extends at least partially through said body;

means defining an inclined, wire-receiving slot in said generally tubular body; said wire-receiving slot communicating with said longitudinal passage and extending from said outer peripheral surface to said inner peripheral surface;

said wire-receiving slot extending at an acute angle relative to the longitudinal axis of said longitudinal passage;

said wire-receiving slot being defined by a pair of spaced, substantially parallel surfaces in a portion of said body; said slot-defining surfaces being inclined from said outer peripheral surface to said inner peripheral surface of said body;

the edge of a portion of said wire receiving slot at the intersection of said slot and said longitudinal passage defining a cutting edge for severing wire;

said wire-receiving slot dividing said longitudinal passage into an upper end and a lower end;

a force transfer member stored in said upper end of said longitudinal passage; said force transfer member being adapted to force a wire portion inserted into said wire-receiving slot against said cutting edge to sever the terminal end of said wire and to force said wire portion into said lower end of said passage; said force transfer member and said internal peripheral wall of said body being adapted to cooperate to strip at least a portion of the insulation from a wire portion when a wire portion is forced into said lower end of said passage by said force transfer member.

2. An electrical wire connector, comprising:

a body member of insulative material; said body member having an outer peripheral surface and an inner peripheral surface defining a passage which extends at least partially through said body; said passage having a longitudinal axis;

means defining an inclined, wire-receiving slot communicating with said longitudinal passage and extending from said outer peripheral surface to said inner peripheral surface of said body member;

said wire-receiving slot extending at an acute angle relative to the longitudinal axis of said passage;

said wire-receiving slot being defined by a pair of spaced, substantially parallel surfaces in a portion of said body; said slot defining surfaces being inclined from said outer peripheral surface to said inner peripheral surface of said body;

said wire-receiving slot dividing said passage into an upper passage and a lower cavity;

a force transfer member stored in said upper passage; said force transfer member being adapted to force a wire portion inserted into said wire receiving slot into said lower cavity; said force transfer member and said internal peripheral wall of said body being adapted to cooperate to strip at least a portion of the insulation from a wire portion when a wire portion is forced into said lower cavity by said force transfer member.

3. In an electrical wire connector comprising an insulating body member having a passage extending at least partially through said body member, said passage having a longitudinal axis, a radial slot in said body member, said radial slot being defined by a pair of slot-defining surfaces, said slot communicating with said passage, and said slot dividing said passage into an upper section and a lower section, and a force transfer member stored in said upper section of said passage; the improvement comprising: said slot being disposed at an acute angle relative to said longitudinal axis of said passage, and said slot-defining surfaces being inclined toward said passage to facilitate inserting and maintaining a wire portion in said passage.

* * * * *

UNITED STATES PATENT OFFICE

CERTIFICATE OF CORRECTION

Patent No. 3,983,312 Dated September 28, 1976

Inventor(s) HARRY A. FAULCONER

It is certified that error appears in the above-identified patent and that said Letters Patent are hereby corrected as shown below:

Column 8, line 15, "downwardly to" should read --downwardly by--.

Signed and Sealed this twenty-third Day of August 1977

[SEAL]

Attest:

RUTH C. MASON
Attesting Officer

C. MARSHALL DANN
Commissioner of Patents and Trademarks